United States Patent [19]

Carson, Jr.

[11] Patent Number: 4,782,686

[45] Date of Patent: Nov. 8, 1988

[54] TUBE BENDER FOR GREENHOUSE STRUCTURAL SUPPORTS

[76] Inventor: Edward C. Carson, Jr., 204 Forest Dr., Greenwood, S.C. 29646

[21] Appl. No.: 56,961

[22] Filed: Jun. 1, 1987

[51] Int. Cl.[4] ..... B21D 7/022

[52] U.S. Cl. ..... 72/389; 72/373; 72/374; 72/453.16; 72/456

[58] Field of Search ..... 72/389, 373, 374, 385, 72/386, 453.03, 453.16, 453.14, 456

[56] References Cited

U.S. PATENT DOCUMENTS

| | | | |
|---|---|---|---|
| 1,700,751 | 2/1929 | Vincent . | |
| 1,775,762 | 9/1930 | Harvey . | |
| 1,899,280 | 2/1933 | Lidseen . | |
| 2,649,128 | 8/1953 | Schoellerman | 153/48 |
| 2,871,908 | 2/1959 | Flessate | 153/38 |
| 2,901,023 | 8/1959 | Teitelman | 153/48 |
| 2,955,639 | 10/1960 | Brown | 153/38 |
| 3,011,750 | 12/1961 | Johnson et al. | 72/453.16 |
| 3,344,635 | 10/1967 | Van Allen | 72/34 |
| 3,429,157 | 2/1969 | Huth | 72/32 |
| 3,442,111 | 5/1969 | Ledford et al. | 72/389 |
| 3,512,392 | 5/1970 | Gregg | 72/389 |
| 3,537,290 | 11/1970 | Garner et al. | 72/324 |
| 3,967,489 | 7/1976 | Pohl et al. | 727/367 |
| 4,005,593 | 2/1977 | Goldberg | 72/389 |
| 4,242,903 | 1/1981 | Ledford et al. | 72/453.01 |
| 4,254,651 | 3/1981 | Kelly | 72/389 |
| 4,265,106 | 5/1981 | McMaster et al. | 72/389 |
| 4,558,583 | 12/1985 | Shaw, Sr. et al. | 72/389 |
| 4,569,219 | 2/1986 | Threlkel et al. | 72/381 |
| 4,574,611 | 3/1986 | Hegemann | 72/389 |

FOREIGN PATENT DOCUMENTS

| | | | |
|---|---|---|---|
| 880920 | 4/1943 | France | 72/389 |
| 562088 | 2/1959 | Italy | 72/389 |

*Primary Examiner*—David Jones
*Attorney, Agent, or Firm*—Dority & Manning

[57] ABSTRACT

A tube bending apparatus includes a substantially vertical structure with a bending shoe reciprocally mounted in a vertical plane. The ends of such shoe ride in parallel vertical guide channels, while the center of the bending shoe is powered preferably by a single controllable pressing mechanism such as a hydraulic cylinder. Respective capture members are positioned at the top of each guide channel for capturing an initially substantially straight tube therein for bending. During a bending operation, the pressing mechanism raises the bending shoe upward in opposition to the capture members so that the tube is bent between such elements. Return springs may be provided symmetrically positioned on each side of the pressing mechanism for lowering the bending shoe subsequent to a bending operation. Preferably, the bending apparatus progressively forms an approximate 60° bend in a tube of up to $1\frac{5}{8}$ inch diameter so that the resulting tube is bent without crimping. The resulting tube is particularly suited for joining abutting apex roof portions and roof-sidewall portions defining structural support for a utility building, especially such as a greenhouse.

14 Claims, 3 Drawing Sheets

TUBE BENDER FOR GREENHOUSE STRUCTURAL SUPPORTS

BACKGROUND OF THE INVENTION

This invention in general concerns a tube bender, and more particularly concerns a tube bending apparatus especially adapted for efficiently forming structural supports for use in fabricating a utility building, such as a greenhouse.

The present application is based on subject matter disclosed in confidence to the U.S. Patent and Trademark Office through the Disclosure Document Program thereof. The subject disclosure was deposited on Jan. 27, 1987 and assigned Disclosure Document No. 162707.

Various devices for bending tubes or similar items are generally known, and have long been in use. Some are provided with relatively fixed configurations for performance of specific tasks while others include interchangeable parts for permitting the selection of curvature characteristics to be induced into a subject pipe tube, or wire.

As examples of some prior art devices, Lidseen (U.S. Pat No. 1,899,280) discloses a generally vertical structure having a curved shoe which is controllably moved upward by a fluid pressure cylinder for bending tubes captured between such shoe and bending rollers. The bending shoe does not extend the full width between the bending rollers, and is not guided in parallel upright guide channels. Allen (U.S. Pat. No. 3,344,635) and Goldberg (U.S. Pat. No. 4,005,593) disclose similar type bending devices, having reduced sized bending shoes. Opposed triangular-shaped plates of Allen partially guide its respective bending shoe so long as the shoe is adjacent its retracted position. Harvey (U.S. Pat. No. 1,775,762) and Gregg (U.S. Pat. No. 3,512,392) disclose various tube benders having bending shoes which extend substantially between opposing capture members, but none of which are guided in parallel, vertical guide channels. Huth (U.S. Pat. No. 3,429,157) and Shaw, Sr. et al. (U.S. Pat. No. 4,558,583) both disclose tube benders having interchangeable bending shoes of different sizes for achieving different selected curvatures in the resulting bent tube.

SUMMARY OF THE INVENTION

It is a general object of the present invention to provide an improved tube bending apparatus. It is a more particular object of this invention to provide an improved tube bending apparatus which is especially adapted for the efficient production of multiple structural support members for use in manufacturing a predetermined configuration utility building, such as a greenhouse.

To uniformly achieve the production of a plurality of predetermined shaped structural support elements in an efficient manner, a bending apparatus in accordance with the present invention is configured for balanced, well-guided bending operations. More particularly, an apparatus in accordance with the present invention includes a substantially vertical structure with a vertically-movable bending shoe, the ends of which ride in parallel vertical guide channels. As further aspects of the present invention, the center of the bending shoe may be powered by a single controllable pressing mechanism, while return springs may be symmetrically positioned on each side of the pressing mechanism for smoothly returning the bending shoe to an initial, retracted position after a bending operation.

In accordance with yet further aspects of the present invention, respective capture members may be positioned at the top of each vertical guide channel for capturing a tube therein for bending. During a bending operation, the controllable pressing mechanism may raise the bending shoe upward in opposition to such capture members so that a tube received therein is bent therebetween. Such well-guided bending operation permits rapid and reliable repetitive bending operations, which contribute to the over-all efficiency objects of this invention, particularly whenever the subject bending apparatus is configured for the production of predetermined curvature structural support elements for a given structure incorporating a number of the resulting curved tube or pipe members.

While various features of the present invention may be combined to provide a given embodiment in accordance with this invention, one exemplary embodiment of this invention is directed to a tube bending apparatus for imparting a predetermined radius of curvature to an initially substantially straight length of tube without crimping same, such apparatus comprising: a substantially horizontal support base; a pair of spaced parallel, vertical guide channels supported on the base with a predetermined separation therebetween; a pair of tube capture elements, one each mounted at the top of each of the guide channels, for upwardly capturing pipe contained in the guide channels to be bent; a bending shoe, received within and extending transversely between the guide channels for controlled vertical reciprocation guided therein, such bending shoe having a lower surface adapted to be driven upwardly during a tube bending operation, and a curved upper surface adapted for engaging the tube to be bent and progressively imparting the desired predetermined radius of curvature thereto during such tube bending operation; and controllable driving means, operatively situated between the support base and the bending shoe lower surface, for selectively driving the bending shoe upward to perform a tube bending operation on an initially substantially straight tube residing in the guide channels and between the bending shoe curved upper surface and the capture elements, such tube being forced to conform to the curvature of the bending shoe upper surface by continued upward driving of the shoe after such tube is engaged with the tube capture elements.

Another exemplary embodiment in accordance with this invention is directed to a support structure shaping device for shaping tubing to be used for structurally supporting a utility building, such device comprising: a pair of spaced upright guide channels with a bending shoe entrained therein for controlled reciprocable movement of the shoe in such channels, the top of each such channel being limited by a tubing upward limitation element; a base support frame secured between respective bases of the guide channels; biasing means for biasing the bending shoe towards the support frame adequately so that initially unbent tubing to be shaped may be received in the guide channels, and situated above the bending shoe but beneath the tubing upward limitation elements; and an actuatable lift cylinder supported on the support frame generally centrally beneath the bending shoe, and having an extendable piston rod operatively engaged with the bending shoe for controllably raising same; wherein selected operation of the lift cylinder overcomes the biasing so as to drive the bending shoe upward towards the top of the respective guide channels, and thereby impart the desired shaping to tubing situated between the bending shoe and the tubing upward limitation elements, whereby tubing of predetermined shaping may be obtained for use in structurally supporting a utility building, such as a greenhouse.

Yet another exemplary construction in accordance with the present invention includes a tube bender for efficiently producing a radius of curvature in a length of initially straight steel tube of up to $1\frac{5}{8}$ inches in diameter resulting in an approximately 60° bend in such tube without crimping same, the resulting tube being suitably formed for joining abutting apex roof portions and roof/sidewall portions of structural support for a greenhouse having enhanced load-bearing characteristics due to the resulting substantially triangular-shaped structural support, such tube bender comprising: a substantially vertical structure having a vertically-movable bending shoe, the ends of which move in parallel vertical guide members, and the center of which is powered by a single controllable pressing means, respective capture members being positioned at the top of each guide member for capturing a tube therein for bending, wherein during a tube bending operation the pressing means raises the bending shoe upward in opposition to the capture members so that a tube residing in the vertical guide members is bent therebetween.

Further objects, features, and aspects of the present invention will be understood by those of ordinary skill in the art upon reading the remainder of the present specification. All modifications and variations to such features which would occur to those of ordinary skill in the art, including substitution of equivalent elements and structures, and reversal of given elements or features of this invention, are intended to come within the spirit and scope of the present invention by virtue of present reference thereto.

BRIEF DESCRIPTION OF THE DRAWINGS

An enabling disclosure of a presently preferred exemplary embodiment of the present invention, including the best mode thereof, may be understood by those of ordinary skill in the art upon their reading the entire present specification, including reference to the accompanying figures, in which.

Figure 1:
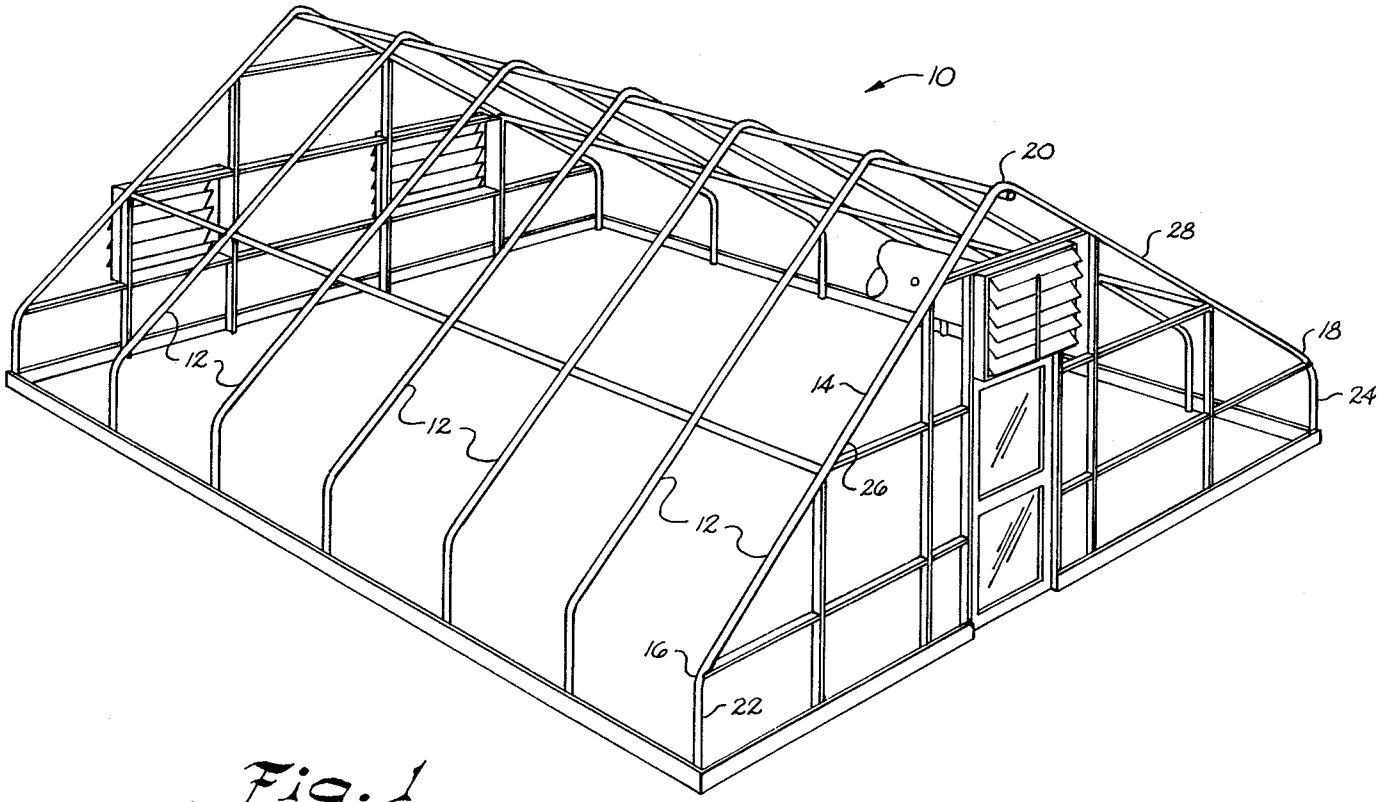
FIG. 1 illustrates structural supports for an exemplary utility building, such as a greenhouse, which may be constructed with curved structural support elements formed by a tube bending apparatus provided in accordance with the present invention.

Repeat use of reference characters throughout the present specification and the accompanying drawings is intended to represent same or analogous elements or features of this invention.

DETAILED DESCRIPTION OF THE PREFERRED EMBODIMENT

The advantages of utilizing a tube bender provided in accordance with the present invention are best realized during construction of a structure or structures fabricated with a plurality of bent tubular elements having substantially identical curvature characteristics. Present FIG. 1 illustrates an example of such a structure, wherein the skeletal supports for a greenhouse 10 generally comprise a plurality of interconnected curved and straight metal tubing pieces. In particular, the roof and sidewalls may be supported by a plurality of generally parallel ceiling joists 12, each of which integrally include a plurality of straight tubular members and preferably three curved areas. Preferably, to facilitate repetitive, efficient production of the structural elements forming greenhouse 10, each joist 12 is essentially identical. Accordingly, only one exemplary joist 14 is discussed in detail below.

Joist 14 includes curved areas 16 and 18 which result in opposing straight sidewall areas 22 and 24. The remainder of joist 14 defines a pair of substantially straight ceiling areas 26 and 28 which integrally join at curved roof apex area 20. Preferably, the curvature in areas 16, 18, and 20 are essentially identical so that all such curves for joists 14 (as well as all other joists 12) may be repetitively and efficiently produced by a single tube bending apparatus. Various lengths of tubing may be pieced together to form a single joist 14, or alternatively a single piece of tubing may be repetitively bent into the shape of the joist as illustrated in present FIG. 1.

The resulting configuration of greenhouse 10 possesses advantages over some known shapes, e.g., such as quonset hut-type shapes, by maximizing ceiling height adjacent the sidewall members while providing a strong generally triangular-shaped structure. Additionally, the construction of greenhouse 10 advantageously lends itself to economically efficient production by repeated use of bending operations with an apparatus in accordance with this invention to fabricate virtually the entire support structure of the greenhouse.

Figure 2:
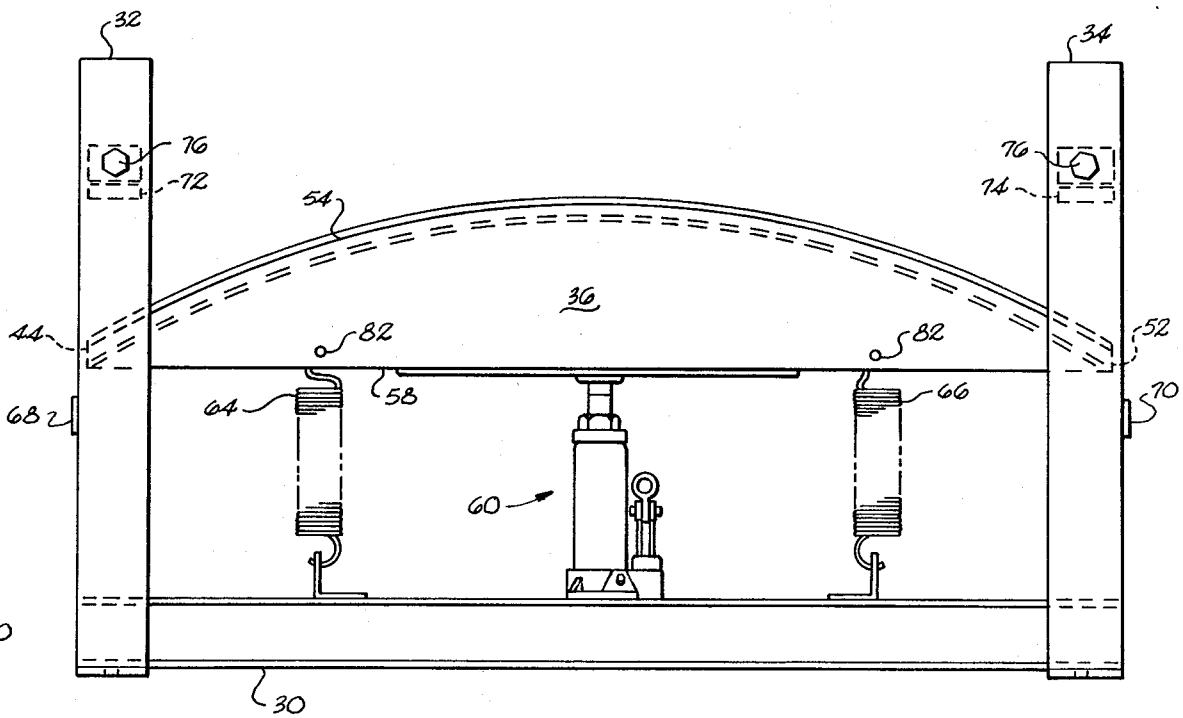
FIGS. 2–4 illustrate a plan view, side view, and perspective view, respectively, of a preferred exemplary tube bender in accordance with this invention.
Figure 3:
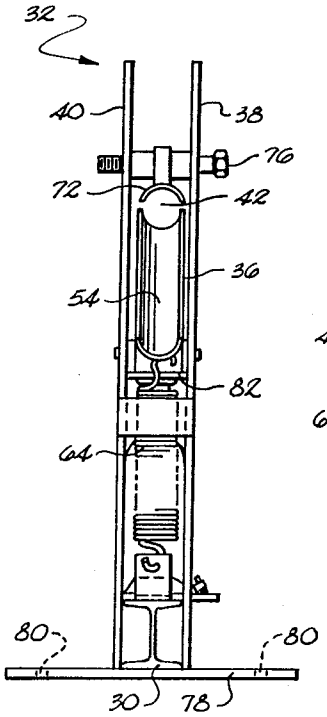
Figure 4:
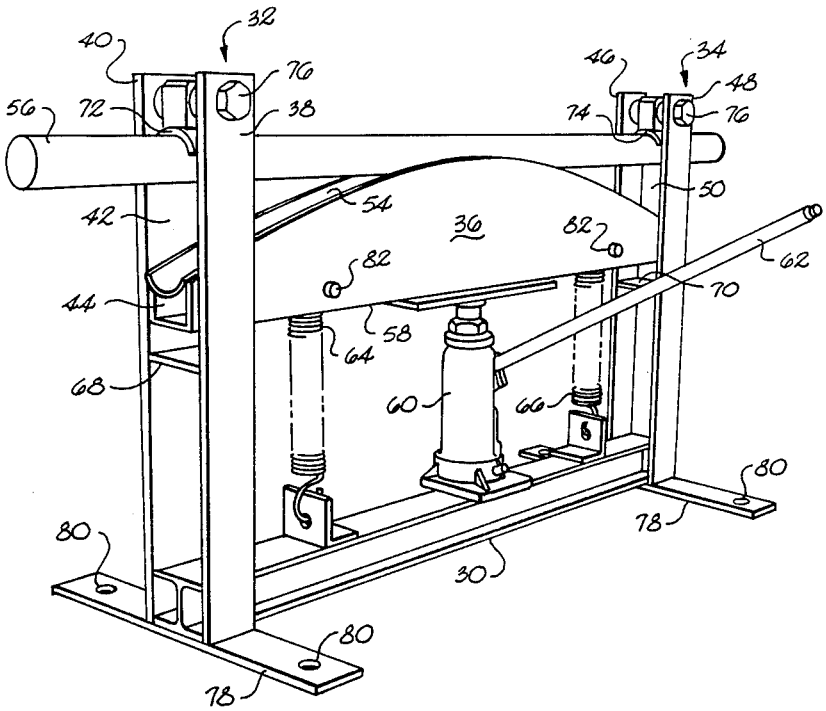

FIGS. 2–4 illustrate various views of a presently preferred exemplary embodiment of a tube bending apparatus in accordance with the present invention. FIG. 3 is a side or end view of the FIG. 2 plan view, while FIG. 4 is a perspective of the exemplary apparatus, further including a substantially straight tube positioned therein prior to a bending operation.

In general, the exemplary tube bending apparatus includes a substantially horizontal support base 30 with a pair of spaced parallel, vertical guide channels 32 and 34 supported on such base. The pair of guide channels include a predetermined amount of separation therebetween. Each guide channel preferably includes an opposing pair of planar rectangular members defining a guide area therebetween for receipt and guidance of a lateral end of a bending shoe 36. For example, guide channel 32 includes opposing planar members 38 and 40 which define a guide area 42 therebetween for receipt of lateral end 44 of bending shoe 36. Guide channel 34 similarly includes opposing planar members 46 and 48 defining a guide area 50 therebetween for receipt and guidance of lateral end 52 of bending shoe 36.

Bending shoe 36 includes an upper curved surface 54 which extends the full longitudinal length of shoe 36 between lateral ends 44 and 52 thereof. Such curved surface 54 is adapted to receive a tube element 56 for bending of same during a tube bending operation, as further described in detail below. A lower surface 58 of shoe 36 is adapted to be selectively driven in preferably a central area thereof by a controllable driving means 60. In this instance, such controllable driving means preferably comprises a manually-actuatable hydraulic cylinder having an arm 62 which may be manipulated as understood by those of ordinary skill in the art for selectively raising bending shoe 36 in a vertically upward direction, since the base of the hydraulic cylinder is otherwise engaged on support base 30. The width of respective guide areas 42 and 50 are selected to be just larger than the width of the bending shoe lateral ends which they respectively guide so that the bending shoe itself is smoothly and efficiently guided in a vertically-oriented plane during bending operations. The relatively central driving location of controllable driving means 60 further contributes to the smooth and efficient bending operation obtained by practicing the present invention.

Spring means preferably comprising a pair of springs 64 and 66 are symmetrically disposed about the controllable driving means for urging bending shoe 36 downwards towards support base 30 (i.e. in a direction opposite to the selective upward driving force of driving means 60). Cooperating therewith, a pair of interference plates 68 and 70, situated in guide areas 42 and 50 respectively, define stop means for establishing the lowest permitted position of bending shoe 36 relative the guide channels. Such lowest permitted position provides adequate' separation between the bending shoe upward surface 54 and tube capture elements 72 and 74 to permit unrestricted removal and insertion of tubing therebetween. Such tube capture elements preferably have curved receipt surfaces adapted for receipt of tubing to be bent, and are situated respectively near upper ends of guide channels 32 and 34. Such capture members may be variously positioned within the guide channels with use of alternative securement means, although a single bolt 76 between opposing members defining a guide channel is adequate to properly secure a capture member in place, as illustrated.

The foregoing adequately describes particular structural features and aspects of the presently preferred exemplary embodiment, additional aspects of which will be readily apparent to those of ordinary skill in the art upon considering the accompanying figures, even without additional description thereof. For example, those of ordinary skill in the art will understand and appreciate upon inspection of the drawings that support base 30 and the bottom of guide channels 32 and 34 may be better stabilized by the addition of transverse leg members 78 thereto, which legs may in turn be secured to a floor or other desired surface with bolts, screws, or the like engaged through openings 80 provided in such leg members. Also, as a further example, cross members 82 may be provided through the width of the body of bending shoe 36 for the securement of respective upper ends of springs 64 and 66, the lower ends of which may be variously engaged with support base 30.

Operation of the presently disclosed tube bending apparatus is preferably as follows.

With bending shoe 36 in a relatively downward position (i.e. initially retracted; as illustrated in FIGS. 2–4, and as achieved with the downward biasing effect provided by springs 64 and 66), a substantially straight section of tubing 56 to be bent may be inserted through guide areas 42 and 50, and thus positioned between curved upper surface 54 and tube capture members 72 and 74. The radius of curvature of curved upper surface 54 and tube capture elements 72 and 74 may be varied as desired to accept tubes of different diameters, with $1\frac{5}{8}$ inches diameter tubing being one preferred size for use with fabricating greenhouse 10 of present FIG. 1. Likewise, the radius of curvature induced into such tubing with the longitudinal curvature of upper surface 54 may be varied as desired, but approximately 60° is adequate and desired for efficiently producing curved areas such as 16, 18, and 20 of greenhouse 10 of present FIG. 1. Additionally, such relative dimensions permit the induction of curvatures into the resulting bent tubes without crimping same.

With bending shoe 36 positioned in its relatively downward orientation, as illustrated in the Figures, metal tubing, pipe, or the like 56 inserted into each of the guide channels so as to pass through the guide areas thereof preferably comes to rest (as illustrated in FIG. 4) between upper curved surface 54 and tube capture elements 72 and 74. Such lateral access of the respective guide areas 42 and 50 permits introduction of a substantially continuous element 56 (instead of only a short section) into the proper position for subsequent bending thereof, thereby permitting formation of an entire joist 12 from a single piece of tubing, if desired. Tubing element 56 of present FIG. 4 is truncated on both ends thereof for illustrative purposes only, and may include integral extensions in either direction, or may be adapted for engagement with additional structural elements as desired.

Once a tube member 56 to be bent is in place (as illustrated in present FIG. 4), controllable driving means 60 may be selectively operated for driving bending shoe 36 in an upward direction, opposing the downward biasing force of springs 64 and 66. As bending shoe 36 continues its movement upward (even after tube 56 is engaged from beneath with upper surface 54 and from above with capture elements 72 and 74), the tubing to be bent begins to conform with the selected (e.g. 60°) predetermined curvature of upper surface 54. Tube 56 is fully conformed to the desired curvature characteristic whenever the entire curvature of upper surface 54 is engaged with a conformed section of tubing 56. At such time, bending shoe 36 may be returned downwardly to permit removal of the resulting bent tubing. Alternatively, an additional length of such tubing may be advanced through the guide areas so that a selected area thereof is positioned opposite bending shoe 36 for having the predetermined curvature characteristic thereof induced into such area of the tubing.

Exemplary tube bending apparatus presently disclosed permits rapid and efficient inducement of the desired curvature characteristics in multiple, sequential sections of tubing without crimping thereof. Moreover, such highly efficient bending operation is rendered smooth and reliable in accordance with various aspects of the present invention as discussed herein, for example wherein the ends of a vertically-movable bending shoe ride in parallel vertical guide channels so as to be reliably guided therein, with a central driving means being balanced between symmetrically positioned return springs for smoothly returning the bending shoe after a bending operation.

While an exemplary embodiment in accordance with the present invention has been discussed in detail, all such discussion has been by way of example and illustration only, and does not preclude inclusion of such modifications and variations to the present invention which would be readily apparent to one of ordinary skill in the art, the scope of the present invention being set forth more particularly in the appended claims.

What is claimed is:

1. A tube bending apparatus for imparting a predetermined radius of curvature to an initially substantially straight, indefinite length of tube without crimping same, said apparatus comprising:

a substantially horizontal, fixed support base, situated substantially at the bottom of said apparatus;

a pair of spaced parallel, vertical guide channels defined by respective opposing pairs of fixed vertical members having opposing ends supported on said base at one end of said members with a predetermined lateral and widthwise separation therebetween defined by said base, to permit introduction into the side thereof an indefinite length of tube;

a pair of tube capture elements, one each mounted at the opposite ends of each of said members defining said guide channels, for capturing pipe contained in said guide channels to be bent;

a bending shoe, received within and having opposing lateral ends extending transversely between said guide channels for controlled reciprocation of said bending shoe with said lateral ends thereof guided in their respective guide channels over the full reciprocation of said bending shoe in said guide channels, said bending shoe having a lower surface adapted to be driven upwardly during a tube bending operation, and a curved upper surface adapted for engaging the tube to be bent and progressively imparting the desired predetermined radius of curvature thereto during said tube bending operation; and controllable driving means, operatively situated between said support base and said bending shoe lower surface, for selectively driving said bending shoe upward to perform a tube bending operation on an initially substantially straight, indefinite length of tube residing in said guide channels and between said bending shoe curved upper surface and said capture elements, such tube being forced to conform to the curvature of said bending shoe upper surface by continued upward driving of said shoe after such tube is engaged with said tube captive elements, and being removable laterally from said apparatus guide channels after said bending operation.

2. An apparatus as in claim 1, wherein:

said controllable driving means includes an actuable hydraulic cylinder supported centrally below said bending shoe on said support base, and having a vertically reciprocal piston operatively engaged with a central area of said bending shoe lower surface for selectively raising said bending shoe; and each of the respective tops of said vertical members are joined with a retaining element which also passes through its respective tube capture element, each of said tube capture elements providing a lower curved engagement surface for accepting the curvature of a tube to be bent.

3. An apparatus as in claim 1, further comprising:

spring means, operatively associated with said support base and said bending shoe, for biasing said bending shoe downward towards said support base; and return stop means for establishing a lowest possible position of said bending shoe within said guide channels, to which position said spring means urges said shoe absent upward driving force on said bending shoe by said controllable driving means.

4. An apparatus as in claim 3, wherein:

said controllable driving means includes a hydraulic cylinder centrally located beneath said bending shoe on said support base for selectively applying upward driving force on a generally centralized area of said bending shoe lower surface;

said spring means includes a pair of spring members symmetrically disposed about said hydraulic cylinder, and respectively attached between said support base and said bending shoe lower surface so as to urge said bending shoe downward towards said support base in a direction opposite to the selective upward driving force of said hydraulic cylinder; and further wherein said stop means includes a pair of interference plates respectively associated with said pair of guide channels for preventing downward vertical reciprocation of said bending shoe within said guide channels below the established position of said interference plates.

5. An apparatus as in claim 1, further comprising:

leg means extending from said support base for supporting said apparatus as a free-standing structure;

spring means for biasing the position of said bending shoe downward towards said support base; and stop means for establishing the lowest permitted position of said bending shoe relative said guide channels; wherein said lowest permitted position of said bending shoe provides adequate separation between said bending shoe upward surface and said tube capture elements to permit unrestricted removal and insertion of tubing therebetween.

6. A support structure shaping device for shaping indefinite length tubing to be used for structurally supporting a utility building, said device comprising:

a pair of spaced upright guide channels with respective tops and bases and open, lateral sides; a bending shoe with lateral sides entrained therein for controlled reciprocable movement of said shoe sides respectively in such channels, the top of each such channel being limited by a tubing upward limitation element;

a base support frame secured between respective bases of said guide channels for supporting same and defining the width thereof;

biasing means for biasing said bending shoe towards said support frame adequately so that initially unbent indefinite-length tubing to be shaped may be received in said guide channels through said open, lateral sides thereof, and situated above said bending shoe but beneath said tubing upward limitation elements; and an actuable lift cylinder supported on said support frame generally centrally beneath said bending shoe, and having an extendable piston rod operatively engaged with said bending shoe for controllably raising same; wherein selected operation of said lift cylinder overcomes said biasing so as to drive said bending shoe upward towards the top of said respective guide channels with shoe lateral sides continuously guided therein, and thereby impart the desired shaping to tubing situated between said bending shoe and said tubing upward limitation elements, whereby indefinite-length tubing of predetermined shaping may be obtained for use in structurally supporting a utility building, such as a greenhouse.

7. A device as in claim 6, wherein:

said biasing means includes a pair of springs generally symmetrically disposed on either side of said lift cylinder, and respectively interconnecting said base support frame with said bending shoe; and each of said guide channels includes a pair of spaced upright elements further including respective stop members positioned therebetween and intermediate said tops and bases thereof for interfering with reciprocal movement of said bending shoe lateral sides respectively within said guide channels, whereby a lower stopped position is established for said bending shoe.

8. A device as in claim 6, wherein said bending shoe includes a curved upper surface having an elevation curvature of approximately 60° so as to impart such curvature to tubing to be shaped, and further having a concave surface curvature of a radius adequate to accept tubing of up to $1\frac{5}{8}$ inches in diameter.

9. A device as in claim 6, wherein:

said bending shoe has a relative width which is only slightly smaller than the width of said guide channels as defined by said base support frame, and said shoe extends generally between the farthest opposing axial sides of said pair of guide channels, for ensuring respective entrainment of said shoe lateral sides within such channels; and said device further includes an axially elongated pressing plate situated between a lower surface of said bending shoe and said piston rod of said lift cylinder, for providing stable reciprocable operation of said lift cylinder in combination with said biasing means.

10. A device as in claim 6, wherein:

said lift cylinder comprises a hydraulic driving mechanism which is manually actuable; and wherein said device further includes legs transversely associated with said base support frame for stably maintaining said device in a free-standing generally vertical position.

11. A tube bender for efficiently producing a radius of curvature in an indefinite length of initially straight steel tube of up to $1\frac{5}{8}$ inches in diameter resulting in an approximately 60° bend in such tube without crimping same, the resulting tube being suitably formed for joining abutting apex roof portions and roof/sidewall portions of structural support for a greenhouse having enhanced load-bearing characteristics due to the resulting substantially triangular-shaped structural support, said tube bender comprising: a substantially vertical structure having a vertically-movable bending shoe with opposing lateral ends, spaced, parallel vertical guide members with laterally open, aligned sides for receipt of an indefinite length of tubing to be bent, and for entraining and guiding said shoe ends in the respective guide members, and a single controllable pressing means for powering the center of said shoe, wherein said guide members have top ends with respective capture members positioned thereat for capturing a tube laterally received within said guide members for bending, and further wherein during a tube bending operation said pressing means raises said bending shoe upward in opposition to said capture members so that an indefinite length of tube residing laterally situated in said vertical guide members is bent therebetween.

12. A tube bender as in claim 11, further comprising respective return springs symmetrically positioned on each side of said pressing means and attached to said bending shoe for returning same to its initial, lowered position subsequent to a tube bending operation.

13. A tube bender as in claim 12, wherein:

said capture members include concave engagement surfaces directed downwardly for engaging tubes without crimping same; and said guide members respectively include stop members positioned intermediate the top ends and opposing, respective bottom ends of each guide member for defining said initial, lowered position of said bending shoe.

14. A tube bender as in claim 11, wherein the amount of bend introduced into a given tube may be selectively established by providing a bending shoe having a predetermined curvature for the upper surface thereof.

* * * * *